United States Patent [19]

Reynolds et al.

[11] 4,255,903

[45] Mar. 17, 1981

[54] SNAP-TOGETHER SEALING GASKET

[76] Inventors: Clarke Reynolds, 15 St. Bernard La., Tiburon, Calif. 94920; Richard J. Quigley, 25538 Adobe La., Los Altos Hills, Calif. 94022

[21] Appl. No.: 58,534

[22] Filed: Jul. 18, 1979

[51] Int. Cl.[3] ..... E06B 7/16

[52] U.S. Cl. ..... 49/498; 49/479

[58] Field of Search ..... 49/498, 493, 489, 475, 49/483, 486, 488, 479

[56] References Cited

U.S. PATENT DOCUMENTS

| | | | |
|---|---|---|---|
| 2,562,957 | 2/1971 | Landis | 49/493 |
| 2,659,940 | 11/1953 | Beck | 49/486 |
| 2,993,243 | 7/1961 | Beauchamp | 49/498 |
| 3,037,251 | 6/1962 | Landis | 49/497 X |
| 3,038,217 | 6/1962 | Harris | 49/497 X |
| 3,371,445 | 3/1968 | Herr et al. | 49/488 X |
| 3,748,215 | 7/1973 | Lenzi | 49/498 X |
| 3,923,411 | 12/1975 | Berghman | 49/486 X |

*Primary Examiner*—Philip C. Kannan

*Attorney, Agent, or Firm*—Harvey G. Lowhurst

[57] ABSTRACT

A bulb-type sealing gasket formed from linear sealing strips and curvelinear sealing corners connected to one another. The sealing strip is constructed from a planar strip of flexible resilient material having end portions which extends substantially perpendicularly to the plane of the sealing strip. The upper sections of the end portions are configured into mounting flanges and the lower sections are configured into cooperating male and female locking elements so that, when the strip is rolled about its longitudinal axis and the cooperating locking elements are snapped together, a bulb-type sealing strip is formed which has a pair of oppositely extending co-planar flanges for mounting upon a closing member.

10 Claims, 5 Drawing Figures

SNAP-TOGETHER SEALING GASKET

BACKGROUND OF THE INVENTION

The present invention relates generally to sealing gaskets, and more particularly to a bulb-type sealing strip which is formed of a generally planar strip and snapped together for sealing an opening in a wall structure with a member adapted to close the opening and to carry the gasket.

While the gasket of this invention is suitable for many sealing applications, it is particularly useful for sealing large openings, such as are encountered in refrigerated railroad cars which are normally subjected to a rather hostile environment and abusive treatment, and which therefore may require replacement several times during the life of the structure which forms the compartment being sealed. And since the closure opening may be as large as 10 to 15 feet wide, the length of the sealing member components are long enough to make ordinary installation quite laborious. For example, it is not unusual for the lengths of gasket required for a single door to exceed 40 feet or more.

Up to the present time, two kinds of bulb-type gaskets have been known. One type is the ordinary gasket in which the center is hollow but the walls are continuously bonded. This type of a gasket must normally be a ready-made gasket which is ordered to size. Another form of gasket is extruded basically flat in the form of a ribbon and is rolled about its longitudinal axis and has edges that are inserted into brackets which are affixed to the door. This type of sealing system is disclosed in U.S. Pat. No. 3,562,957 which issued on Feb. 16, 1971.

Both of these prior art bulb-type gaskets have certain limitations, the continuously bonded type is very heavy and can usually not be provided in linear sections that are rolled up for assembly at the site and therefore is extremely heavy and has to be stored in all necessary sizes. The second type overcomes some of these disadvantages but still requires a metal retainer affixed to the door with facing channels which receive the flanges of the gasket in order maintain the gasket in the rolled up position, with special corners being provided.

SUMMARY OF THE PRESENT INVENTION

It is therefore a primary object of the present invention to provide a gasket which has linear sides which are extruded basically flat and can therefore be stored in rolls and cut to lengths, and which is not dependent upon a metal retainer on the closing element to hold the bulb shape.

It is a further object of the present invention to provide a new kind of bulb-type gasket which is more economical to manufactrue and to store, which can be readily assembled in the field, and which can be directly affixed to the door of a railroad car or the like.

It is another object of the present invention to provide a new system of bulb-type gaskets which retain the simplicity of an extrusion in basically flat ribbon form as far as the linear sides are concerned, which can be readily assembled into bulb shape to hold the bulb and thereafter, and which independently of retaining its bulb shape, can be affixed either directly or through other means to the door.

In accordance with the present invention there is provided an extruded, basically flat ribbon of a resilient, elastomeric material which is substantially flat in the center and has vertically extending end portions. The sections of the end portions extending downwardly are shaped to form cooperating male and female locking elements so that, upon rolling this strip about its longitudinal axis, the cooperating locking elements are brought into into engagement with one another, i.e. snapped together, to hold the shape of the bulb and to form a sealing strip. The sections of the end portions above the ribbon are shaped to provide mounting flanges, extending in opposite directions after the sealing strip is snapped together, for affixation to the closure member, either directly by gluing, or by nailing, or by inserting into mounting brackets either affixed or formed directly into the closure member. They are also provided molded corners, having the same cross section as the sealing strip, to connect to the ends of the sealing strip to form a gasket.

DETAILED DESCRIPTION OF THE DRAWINGS

Figure 1:
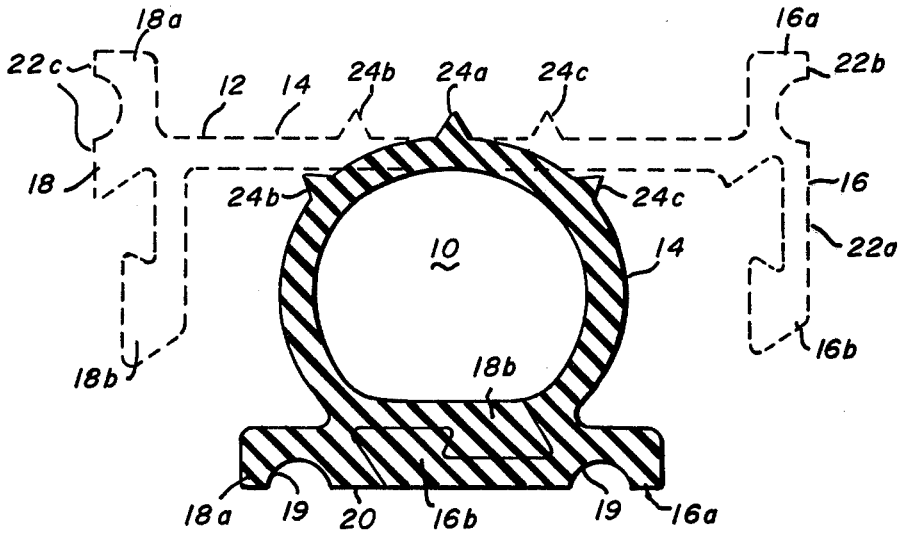
FIG. 1 is a cross sectional view of the linear, bulb-type, sealing strip of the present invention showing the extruded strip in dash lines and the assembled strip in solid lines.

Referring now to FIG. 1, there is shown, in solid lines, the bulb-type linear sealing strip 10 of the present invention upon which is superimposed, in dashed line outline, the generally planar strip 12 in the shape in which it is extruded. Strip 12 is an extruded elastomeric, resilient material and includes a midportion 14 and a pair of end portions 16 and integral with portion 14.

End portion 16 has an upper section **16*a* and a lower section 16*b*, and end portion 18 has an upper section 18*a* and a lower section 18*b*. Lower sections 16*b* and 18*b* are shaped to form cooperating male and female locking elements of trapezoidal cross section which, upon engaging one another, i.e. being snapped together, after strip 12 is rolled along its longitudinal axis, form a bulb-type gasket strip 10 shown in solid lines. Section 16*a* and 18*a* are shaped to form flanges which extend in opposite directions and which may be fastened to a closing member, such as a railroad car door, in any convenient manner. It should also be noted that the lower most portion of the sealing strip 10 is planar with respect to a surface 20 which requires that surfaces 22*a* and 22*b* of end portion 16, and surface 22*c* of end portion 18, be formed to lie in the same plane after assembly. There are also provided three longitudinal sealing edges 24*a*, 24*b* and 24*c*** for additional sealing when the bulb is deformed between two surfaces sealed to one another, and each flange has a longitudinal groove to lighten the weight and to provide an elastic flange portion if the same is nailed to the car door.

Figure 2:
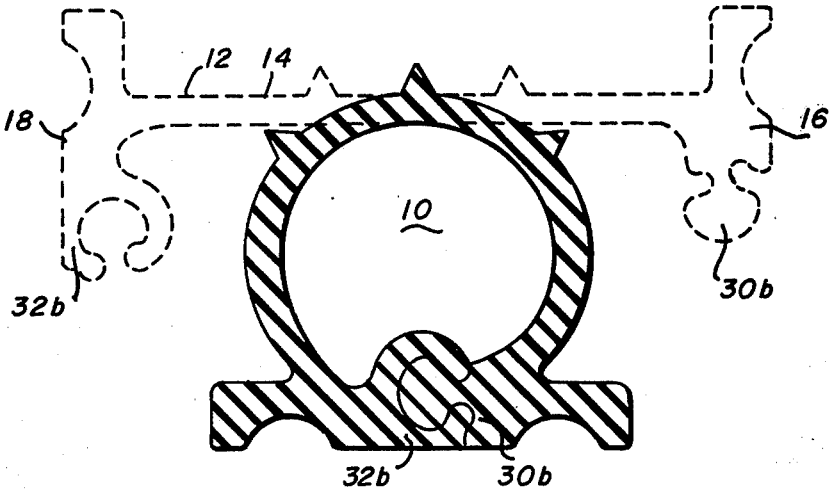
FIG. 2 is another embodiment of the linear, bulb-type, sealing strip illustrated in FIG. 1.

Referring now to FIG. 2, there is shown a sealing strip which is similar in all respects to the structure shown in FIG. 1 except that the cooperating male and female locking elements 30b and 32b are shaped in the form of a bulb which engage each other end-to-end instead of being overlapping along their lengths. The arrangement shown in FIG. 1 provides more security for maintaining the bulb-shape than this embodiment, but the fastening of this FIG. 2 embodiment to the railroad car door makes this a most satisfactory embodiment.

Figure 3:
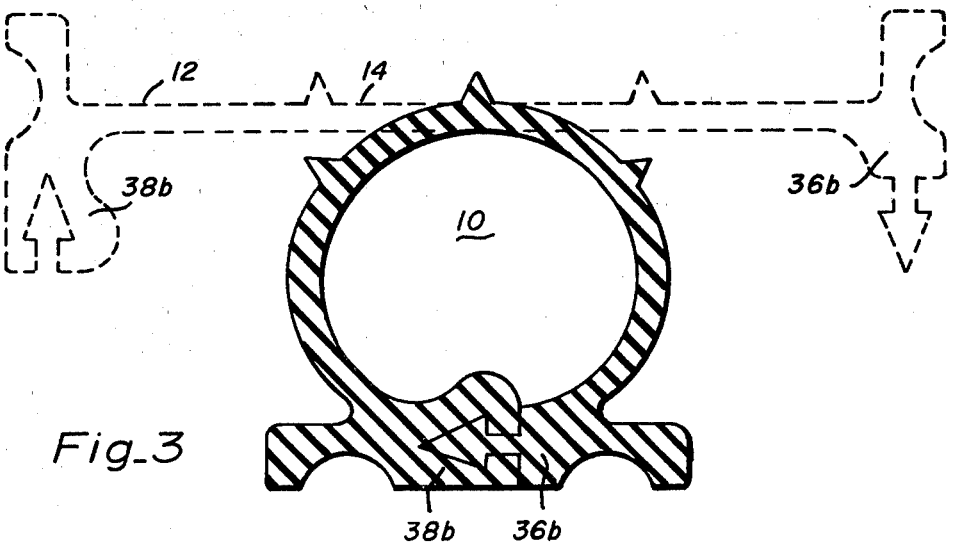
FIG. 3 is a further embodiment of the linear, bulb-type sealing strip illustrated in FIG. 1.

Referring now to FIG. 3, there is shown a sealing strip which is similar in all respects to the one shown in FIG. 1 except that the cooperating male and female locking elements 36b and 38b are arrow shaped and also provide end-to-end engagement.

Figure 4:
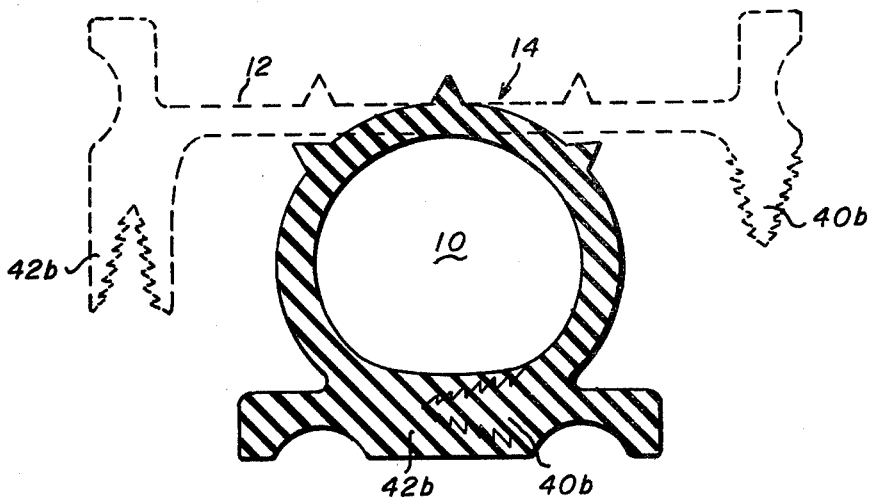
FIG. 4 is still another embodiment of the linear, bulb-type, sealing strip illustrated in FIG. 1.

Referring now to FIG. 4 there is shown still another embodiment of the sealing strip of FIG. 1 which is similar in all respects except that the cooperating male and female locking elements, 40b and 42b are of Christmas tree shape and provide end-to-end engagement.

In an embodiment of the sealing strip of the present invention, designed for use on a heavy railroad car door, the thickness of portion 14 was selected to be 0.09 inches, the outside diameter of the bulb after assembled was 1.25 inches, the distance between the outside wall of the flanges was 1.75 inches, the thickness of each flange was 0.19 inches, and the width of the longitudinal groove in the lower flange surface was 0.31 inches.

Figure 5:
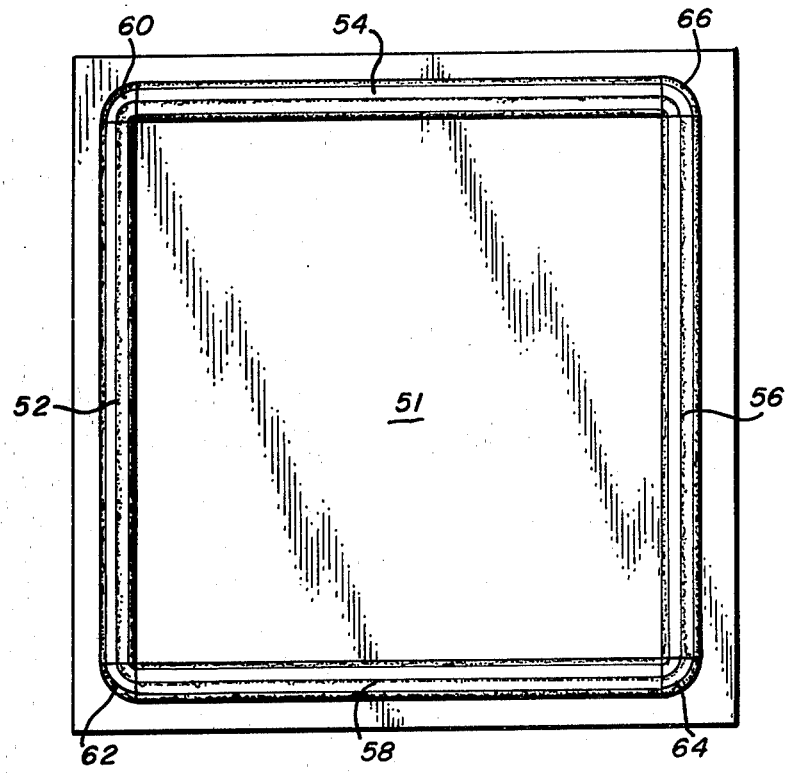
FIG. 5 is plan view of a gasket constructed in accordance with the present invention, utilizing any one of the sealing strips shown in FIGS. 1, 2, 3, or 4, and molded corners.

Referring now to FIG. 5 of the drawings, there is shown a complete gasket 50 which is attached to the interior surface of a door 51 for closing an opening. Gasket 50 is, or may be, field assembled and comprises four linear sealing strips 52, 54, 56 and 58, each constructed in accordance with the present invention as shown in FIGS. 1, 2, 3, or 4. There are further provided molded corners 60, 62, 64 and 66 which may have step-down shoulders so that they may be glued to the ends of strips 52, 54, 56 and 58, facilitating fabrication in the field. As is quite evident from the construction shown in FIG. 5, one big advantage of the system is that the user does not have to stock or order gaskets of a precise measurement, but could fabricate them on site to suit any particular door-opening combination. Further, the method of affixation of the linear strip, as well as the molded corner, to the door may be by gluing or nailing, or the door could be provided with, or utilize a metal retainer into which the flanges of the sealing strip and the molded corner fit.

There has been described a bulb-type gasket which is composed of snapped together linear sealing strips and molded corners. After assembly, the gasket can be mounted on a wooden or steel door, either directly or through a retainer. Even though only four cooperating male and female locking elements for the sealing strip have been illustrated, it is to be understood that there are a large variety of cooperating male-female locking members that may be utilized to snap the gasket together to form a bulb.

What is claimed is:

1. A bulb-type, linear sealing strip for securing to the surface of a member adapted to close an opening in a wall structure, said sealing strip:

being formed from a generally planar strip of elastomeric, resilient material having opposite end portions which extend substantially at right angles to said planar strip, said end portions each having an upper section extending above said planar strip and a lower section extending below said planar strip;

the lower sections being shaped to form cooperating male and female locking elements which, upon being snapped together when the strip is rolled about its longitudinal axis, deform said planar strip into a bulb-type shape; and the upper sections being substantially identical to one another and being shaped to form a pair of flanges for mounting said gasket to the surface of the member, said mounting flanges extending into opposite directions for mounting to the member when said locking elements are snapped together.

2. A bulb-type linear sealing strip in accordance with claim 1 in which the lower surfaces of said flanges of the snapped-together gasket are co-planar for securing to the member.

3. A bulb-type linear sealing strip in accordance with claim 2 in which the surface of the snapped-together gasket, which is to be secured to the member, is planar under the cooperating locking elements.

4. A bulb-type linear sealing strip in accordance with claim 1 in which said locking elements are trapezoidal in cross section.

5. A bulb-type linear sealing strip in accordance with claim 1 in which said locking lements are bulb-shaped in cross section.

6. A bulb-type linear sealing strip in accordance with claim 1 in which said locking elements are arrowhead in cross section.

7. A bulb-type linear sealing strip in accordance with claim 1 in which said locking elements Christmas tree shaped in cross section.

8. A bulb-type sealing gasket comprising:

a plurality of bulb-type linear sealing strips, said sealing being formed from a generally planar strip of elastomeric, resilient material having opposite end portions which extend substantially at right angles to said planar strip, said end portions each having an upper section extending above said planar strip and a lower section extending below said planar strip, the lower sections being shaped to form cooperating male and female locking elements which, upon being snapped together when the strip is rolled about its longitudinal axis, deform said planar strip into a bulb-type shape, and both upper sections being substantially identical to one another and being shaped to form a pair of flanges for mounting said gasket to the surface of the member, said mounting flanges extending into opposite directions for mounting to the member when said locking elements are snapped together.

9. A bulb-type sealing gasket in accordance with claim 8 in which the gasket comprises a closed loop.

10. A bulb-type sealing gasket in accordance with claim 8 in which said gasket comprises four linear sealing strips and four corners, and in which the corners include means for sealingly receiving the end portion of said strips.

* * * * *